US006851989B2

(12) United States Patent
Maeda

(10) Patent No.: US 6,851,989 B2
(45) Date of Patent: Feb. 8, 2005

(54) TERMINAL FITTING WITH PLURAL RESILIENT CONTACT PIECES AND PRESSING PORTION FOR HOLDING BASE ENDS OF RESILIENT CONTACT PIECES TOGETHER

(75) Inventor: Taisaku Maeda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/436,911

(22) Filed: May 13, 2003

(65) Prior Publication Data

US 2003/0216085 A1 Nov. 20, 2003

(30) Foreign Application Priority Data

May 15, 2002 (JP) ..... 2002-140481

(51) Int. Cl.[7] ..... H01R 11/22; H01R 13/11
(52) U.S. Cl. ..... 439/852; 439/748
(58) Field of Search ..... 439/851–853, 439/816, 842, 745–748

(56) References Cited

U.S. PATENT DOCUMENTS

| | | | | | |
|---|---|---|---|---|---|
| 4,046,450 | A | * | 9/1977 | Yurtin | 439/746 |
| 4,568,138 | A | * | 2/1986 | McKenzie | 439/723 |
| 4,781,628 | A | * | 11/1988 | Detter et al. | 439/748 |
| 5,664,972 | A | | 9/1997 | Zinn et al. | 439/839 |
| 6,165,026 | A | * | 12/2000 | Sugie et al. | 439/748 |
| 6,283,803 | B1 | * | 9/2001 | Sato et al. | 439/852 |
| 6,679,738 | B2 | * | 1/2004 | Nimura | 439/852 |

* cited by examiner

*Primary Examiner*—Michael C. Zarroli
(74) *Attorney, Agent, or Firm*—Gerald E. Hespos; Anthony J. Casella

(57) ABSTRACT

Two resilient contact pieces (20A, 20B) have base ends (21A, 21B) coupled to each other and folded one over the other, such that the base ends (21A, 21B) are substantially in close contact. A pressing portion (24) presses the two base ends (21A, 21B) from the outside and prevents the base ends (21A, 21B) from opening. Thus, the two resilient contact pieces (20A, 20B) are held one over the other in proper postures.

10 Claims, 3 Drawing Sheets

TERMINAL FITTING WITH PLURAL RESILIENT CONTACT PIECES AND PRESSING PORTION FOR HOLDING BASE ENDS OF RESILIENT CONTACT PIECES TOGETHER

BACKGROUND OF THE INVENTION

1. Field of the Invention

The invention relates to a terminal fitting and a method of forming it.

2. Description of the Related Art

U.S. Pat. No. 5,664,972 discloses a terminal fitting with two resilient contact pieces. The resilient contact pieces have fixed base ends and free ends that contact one another. The double structure of the resilient contact piece is intended to improve the resiliency of the resilient contact piece. Specifically, both resilient contact pieces simultaneously deform in response to contact with a tab of a mating terminal, and hence display a high resilient force.

The terminal fitting of U.S. Pat. No. 5,664,972 is constructed such that a tubular body is put on a terminal main body and a resilient contact piece formed on the tubular body contacts the resilient contact piece formed on the terminal main body from outside. Thus, the two resilient contact pieces are formed as separate parts.

FIGS. 4 to 6 herein show a possible construction for a terminal fitting 100 with two resilient contact pieces formed on one part. The terminal fitting 100 has a main body 101 in the form of a rectangular tube. A side plate 102 is formed on the main body 101 and a first resilient contact piece 103 is cantilevered forwardly along the side plate 102. The first resilient contact piece 103 is formed with a second resilient contact piece 104 cantilevered forwardly along the first resilient contact piece 103. The first and second resilient contact pieces 103, 104 are coupled at their base ends 103*a*, 104*a* along a fold line at the boundary between them, and are brought into close contact with each other. However, the fold may undergo an opening deformation to separate the base ends 103*a*, 104*a*, as shown in phantom line in FIG. 5. Such a deformation causes the resilient contact pieces 103, 104 to become oblique to each other, and could cause an erroneous contact with a tab.

The invention was developed in view of the above problem and an object thereof is to prevent a folded portion of a plurality of resilient contact pieces holding the resilient contact pieces into close contact from opening.

SUMMARY OF THE INVENTION

The invention is a terminal fitting with a plurality of resilient contact pieces having base ends coupled to each other. The base ends are folded and placed at least partly over one another and are held in substantially close contact with each other. At least one pressing portion presses the base ends from the outside for holding the base ends in substantially close contact and for preventing the base ends from being separated. Thus, the resilient contact pieces can be held one over another in proper postures.

The pressing portion preferably extends from one of the base ends and is held substantially in contact with the outer surface of another base end.

The resilient contact pieces preferably are arranged substantially side by side so that free ends of the resilient contact pieces extend substantially in the same directions. The pressing portion preferably projects from the one base end toward a side opposite the free end of the one base end.

One of the resilient contact pieces preferably is longer than the other.

The resilient contact pieces preferably are coupled by at least one coupling portion.

The coupling portion preferably is folded so that the base end of one resilient contact piece is held substantially in surface contact with the surface of the base end of another resilient contact piece.

The coupling portion preferably is accommodated in an escaping groove or hole at a boundary between a side plate and a plate that has the resilient contact pieces.

A protecting plate preferably projects in from a front edge of the plate that has the resilient contact pieces.

The invention also relates to a method of forming a terminal fitting. The method comprises providing a conductive plate material. The method then includes stamping and/or cutting the conductive plate to have a specified shape, and bending, embossing and/or folding the conductive plate to define resilient contact pieces with base ends coupled to each other. The method further includes folding the base ends substantially one over another so that the base ends are substantially in close contact with each other. The method then includes providing at least one pressing portion for contacting the base ends from the outside and preventing the base ends from being separated.

The pressing portion preferably is formed to extend from one of the base ends and is held in substantially close contact with the outer surface of another base end.

The resilient contact pieces preferably are arranged substantially side by side such that free ends thereof extend substantially in the same directions.

The pressing portion preferably is formed to project from the one base end toward a side opposite from the free end of the one base end.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE RELATED ART

Figure 1:
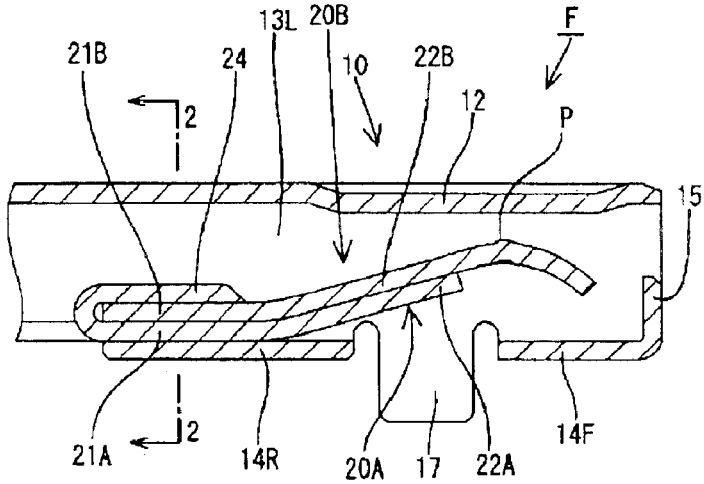
FIG. 1 is a partial section of a terminal fitting according to one embodiment of the invention.
Figure 2:
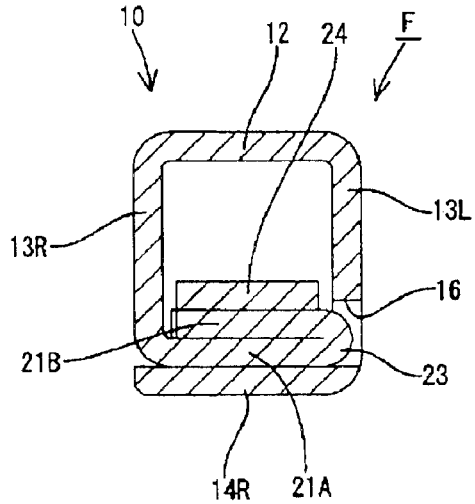
FIG. 2 is a section along 2—2 of FIG. 1.
Figure 3:
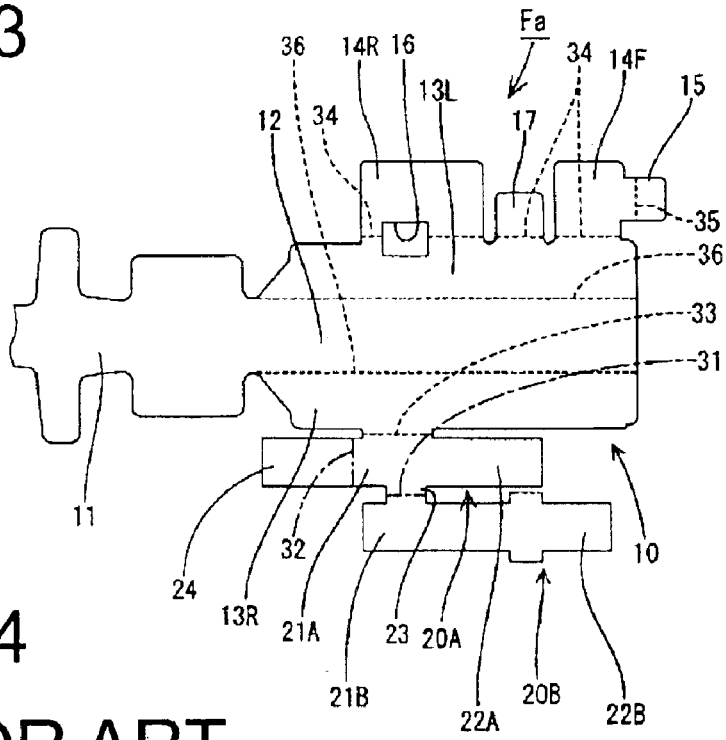
FIG. 3 is a development of the terminal fitting.
Figure 4:
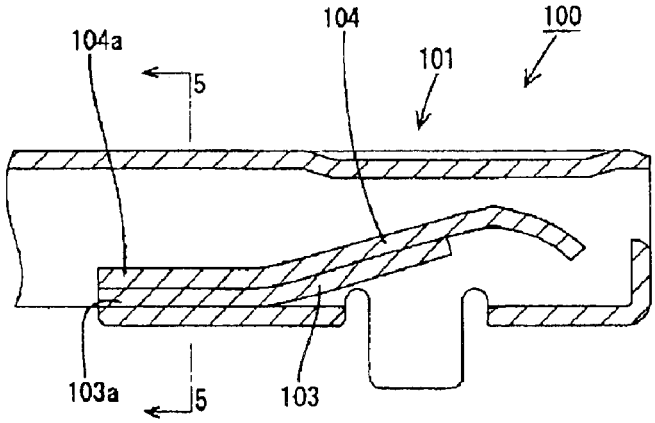
FIG. 4 PRIOR ART
FIG. 4 is a partial section of a prior art terminal fitting.
Figure 5:
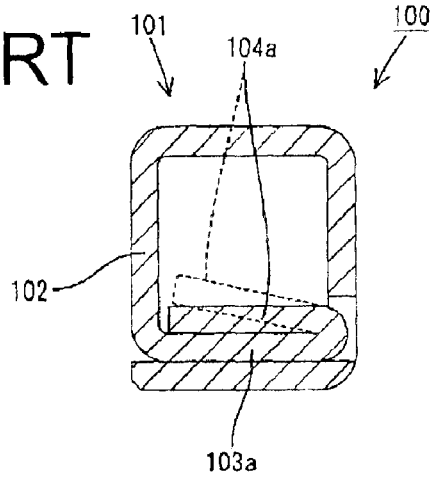
FIG. 5 PRIOR ART
FIG. 5 is a section along 5—5 of FIG. 4.
Figure 6:
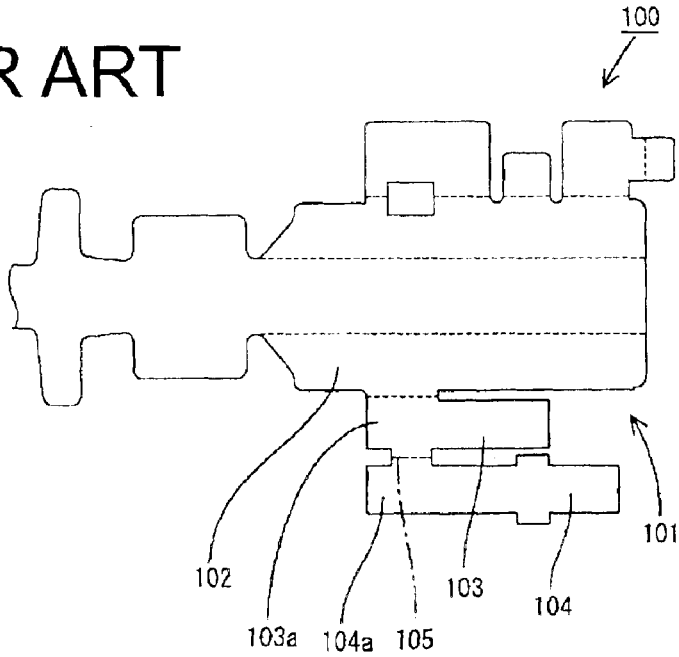
FIG. 6 PRIOR ART
FIG. 6 is a development of the prior art terminal fitting.

The letter F in FIGS. 1 to 3 identifies a female terminal fitting according to the invention. The right side of the female terminal fitting F in FIGS. 1 and 3 is the front side and is configured for mating with a mating terminal fitting (not shown). The terminal fitting F is narrow and long in forward and backward directions. A rectangular tube 10 is formed at the front of the terminal fitting F and is hollow in forward and backward directions. Thus, a tab of an unillustrated male terminal fitting can be inserted into the rectangular tube 10. A wire crimping portion 11 is defined at the rear of the terminal fitting F and defines an open barrel that can be crimped, folded or bent into electrical connection with an end of a wire (not shown). Alternatively, the rear portion may be formed into a wire connecting portion configured for connection with a wire e.g. by insulation displacement, soldering, welding, etc.

The rectangular tube 10 has a long narrow ceiling plate 12. Long narrow left and right side plates 13L, 13R extend down from the opposite left and right edges of the ceiling plate 12 and front and rear bottom plates 14F, 14R extend orthogonally to the right from the bottom edge of the left side plate 13L. The rear end of the ceiling plate 12 is substantially continuous with the wire-crimping portion 11. Further, a protecting plate 15 projects up from the front edge of the front bottom plate 14F. An escaping hole 16 is formed at a boundary between the rear bottom plate 14R and the left side plate 13L. A rectangular plate-shaped stabilizer 17 projects down from the bottom edge of the left side plate 13L at a location between the front and rear bottom plates 14F, 14R. The stabilizer 17 is substantially flush with the left side plate 13L.

Two resilient contact pieces 20A, 20B are provided in the rectangular tube 10 and project forward from rear base ends 21A, 21B that are supported by the rectangular tube 10. The resilient contact pieces 20A, 20B are placed one over the other like a folded leaf spring.

The first resilient contact piece 20A is below the second resilient contact piece 20B. The base end 21A of the first resilient contact piece 20A extends leftward at substantially a right angle from the bottom edge of the right side plate 13R at a position slightly displaced from the center toward the rear end, and is held substantially in surface contact with the upper surface of the rear bottom plate 14R. A contact 22A of the first resilient contact piece 20A obliquely extends up to the front from the base end 21A.

The second resilient contact piece 20B is located above and substantially continuous with the first resilient contact piece 20A. The rear base end 21B of the second resilient contact piece 20B is unitary with the left edge of the base end 21A of the first resilient contact piece 20A via a coupling 23. The coupling 23 is folded so that the base end 21B of the second resilient contact piece 20B is held substantially in surface contact with the upper surface of the base end 21A of the first resilient contact piece 20A. Thus, the base end 21B of the second resilient contact piece 20B, the base end 21A of the first resilient contact piece 20A and the bottom plate 14R are placed substantially one over another in this order from inside (see FIG. 2).

A contact 22B extends obliquely up to the front from the base end 21B of the second resilient contact piece 20B and extends more forward than the contact 22A of the first resilient contact piece 20A. The contacts 22A and 22B are substantially parallel to each other. An extending end of the base end 21B is bent obliquely down to the front. The uppermost end (tip close to the extending end) of the contact 22B defines as a contact point P with the tab, and a space narrower than the thickness of the tab is defined between the contact point P and the lower surface of the ceiling plate 12. The ceiling plate 12 is embossed in at a position opposite the contact point P.

The contact 22A of the first resilient contact piece 20A is held in substantially close contact with the lower surface of the contact 22B of the second resilient contact piece 20B over substantially the entire length thereof which is substantially the entire area from the base end 21A to the free end. Accordingly, a tab inserted into the rectangular tube 10 is held resiliently between the lower embossed surface of the ceiling plate 12 and the contact point P of the second resilient contact piece 20B. Therefore, a high contact pressure can be ensured by the resilient forces of both first and second resilient contact pieces 20A, 20B.

As described above, the base ends 21A, 21B of the resilient contact pieces 20A, 20B are folded to place the contacts 22A, 22B in close contact over one another. However, a restoring force of the folded coupling 23 could cause the base ends 21A, 21B to undergo an opening deformation that could separate the base ends 21A, 21B from each other. Accordingly, a pressing portion 24 is provided as a countermeasure. The pressing portion 24 is a rectangular plate folded into a substantially U-shape to extend forward from the rear edge of the base end 21A of the first resilient contact piece 20A. Thus, the pressing portion 24 is pressed in substantially surface contact with the upper surface of the base end 21B of the second resilient contact piece 20B. Accordingly, the base end 21B of the second resilient contact piece 20B is held tightly between the base end 21A of the first resilient contact piece 20A and the pressing portion 24 that extends from this base end 21A. This prevents the base end 21B of the second resilient contact piece 20B from displacing up from the base end 21A of the first resilient contact piece 20A in a manner that would open the base ends 21A, 21B.

The terminal fitting F is formed from an initially flat unitary blank Fa of conductive metallic plate material that is been stamped and/or cut out into a specified shape, as shown in FIG. 3. The blank Fa then is bent, embossed or folded. The long narrow second resilient contact piece 20B is at the right end of the blank Fa. The long narrow first resilient contact piece 20A has a free end that extends in substantially the same direction as the second resilient contact piece 20B and a base end 21A that is substantially continuous with the left edge (upper edge in FIG. 3) of the base end 21B of the second resilient contact piece 20B. The long narrow right side plate 13R is substantially continuous with the left edge of the base end 21A of the first resilient contact piece 20A and is substantially parallel with the first resilient contact piece 20A. The ceiling plate 12 is continuous with the left edge of the right side plate 13R; the left side plate 13L is continuous with the left edge of the ceiling plate 12; and the front and rear bottom plates 14F, 14R and the stabilizer 17 are continuous with the left side plate 13L. The pressing portion 24 extends back from the base end 21A of the first resilient contact piece 20A in a direction opposite from the contact portion 22A at the free end of the first resilient contact piece 20A. Additionally, the first resilient contact piece 20A and the pressing portion 24 are substantially continuous with each other to define a long narrow and long plate. In other words, the first and second resilient contact pieces 20A, 20B, the right side plate 13R, the ceiling plate 12, the left side plate 13L, the front and rear bottom plates 14F, 14R and the stabilizer 17 are substantially rectangular.

The metallic blank Fa is formed by first curving the contacts 22A, 22B of the respective resilient contact pieces 20A, 20B. The coupling 23 between the resilient contact pieces 20A, 20B then is folded along a fold line 31 that extends forward and backward to bring the base ends 21A, 21B into substantially close contact. This folding also brings the contacts 22A, 22B into substantially close contact. The pressing portion 24 then is folded to extend forward with respect to the base end 21A along a substantially transverse folding line 32 at the rear end of the first resilient contact piece 20A and is placed on the base end 21B of the second resilient contact piece 22B.

The resilient contact pieces 20A, 20B then are bent at substantially a right angle to the right side plate 13R along a fold line 33 that extends forward and back at the bottom edge of the right side plate 13R. Subsequently, the front and rear bottom plates 14F, 14R are bent at substantially right angles along a fold line 34 that extends forward and back at the bottom edge of the left side plate 13L, and the protecting plate 15 is bent at substantially a right angle along a folding line 35 that extend in a transverse direction at the front edge of the front bottom plate 14F. The left and right side plates 13L, 13R then are bent at substantially right angles along fold lines 36 that extend forward and back at the opposite right and left edges of the ceiling plate 12. By bending the side plates 13L, 13R, the upper surface of the rear bottom plate 14R and the lower surface of the base end 21A of the first resilient contact piece 20A are placed substantially one over the other substantially in surface contact. The folded coupling 23 is accommodated in the escaping groove 16 at the boundary between the left side plate 13L and the rear bottom plate 14R. In this way, the bending process is completed to obtain the final terminal fitting F.

The base ends 21A, 21B of the folded two resilient contact pieces 20A, 20B are held substantially in close contact with each other and are prevented from opening by the pressing portion 24. Thus, the two resilient contact pieces 20A, 20B are held substantially one over the other in proper postures.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shorter first resilient contact piece is held substantially in close contact with the longer second resilient contact piece over the entire length thereof in the foregoing embodiment. However, only the free end of the shorter first resilient contact piece may be held in contact with the longer second resilient contact piece according to the present invention.

Although the two resilient contact pieces have different lengths in the foregoing embodiment, they may have the same length.

The second resilient contact piece to be held in contact with the tab is longer in the foregoing embodiment. However, the resilient contact piece that is not held in contact with the tab may be longer.

The two resilient contact pieces are substantially side-by-side in the flat blank of the terminal fitting in the foregoing embodiment. However, they may be aligned in a straight line according to the present invention. In such a case, the base ends of both resilient contact pieces are substantially continuous and the free ends thereof extend in opposite directions.

The pressing portion extends from the shorter first resilient contact piece in the foregoing embodiment. However, the pressing portion may extend from the longer resilient contact piece or from the bottom plate according to the present invention.

The two resilient contact pieces extend from the right side plate in the foregoing embodiment. However, they may extend from the bottom plate. In such a case, the pressing portion may extend from the resilient contact piece or from the bottom plate.

The resilient contact pieces are in the form of cantilevers projecting forward in the foregoing embodiment. However, they may extend backward along the tab inserting direction according to the present invention.

Two resilient contact pieces are placed one over the other in the foregoing embodiment. However, three or more resilient contact pieces may be placed one over another according to the present invention. In such a case, the resilient contact pieces preferably may be bent in a zigzag or spiral manner.

What is claimed is:

1. A terminal fitting having opposite front and rear ends and defining a longitudinal direction extending between the ends, comprising:

at least first and second resilient contact pieces having first and second base ends coupled unitarily to each other and at least partly placed substantially one over another by being folded along a fold line extending substantially parallel to the longitudinal direction of the terminal fitting such that the base ends are held substantially in close contact with each other, and at least one pressing portion extending unitarily from the base end of the first resilient contact piece and folded about a fold line extending transverse to the longitudinal direction into substantially face-to-face contact with the base end of the second resilient contact piece for preventing the base ends from being separated by contacting and pressing the base end from a side of the second resilient contact piece opposite the first resilient contact piece.

2. The terminal fitting of claim 1, wherein the resilient contact pieces have free ends that extend substantially in the same directions from the base ends thereof.

3. The terminal fitting of claim 1, wherein the second resilient contact piece is longer than the first resilient contact piece.

4. A terminal fitting, comprising:

at least first and second resilient contact pieces having first and second base ends coupled to each other by at least one coupling that is folded so that the second base end is held substantially in surface contact with the first base end; and at least one pressing portion for preventing the base ends from being separated by contacting and pressing at least one of the base ends from outside, wherein the coupling is accommodated in an escaping groove at a boundary between a side plate and a plate on which side the resilient contact pieces are provided.

5. A terminal fitting, comprising:

at least first and second resilient contact pieces having first and second base ends coupled to each other and at least partly placed substantially one over another by being folded such that the base ends are held substantially in close contact with each other;

at least one pressing portion for preventing the base ends from being separated by contacting and pressing at least one of the base ends from outside a side of the second resilient contact piece opposite the first resilient contact piece; and a protecting plate projecting inwardly from a front edge portion of a plate on which side the resilient contact pieces are arranged.

6. A terminal fitting, comprising a substantially rectangular tube having a ceiling wall, first and second side walls extending unitarily from opposite side edges of the ceiling wall (12) and a bottom wall extending unitarily from an edge of the first side wall remote the ceiling wall toward an edge of the second side wall remote from the ceiling wall, a first resilient contact piece having first base extending unitarily from the second side wall and folded into substantially face-to-face contact with a portion of the bottom wall, the first resilient contact piece further having a first contact cantilevered up from the first base and away from the bottom wall, a second resilient contact piece having a second base extending unitarily from the first base and folded into substantially face-to-face contact with the first base, the second resilient contact piece further having a second contact cantilevered from the second base and disposed in substantially face-to face contact with the first contact, and a pressing portion extending unitarily from the first base and folded into pressing contact with a surface of the second base opposite the first base.

7. The terminal fitting of claim 6, comprising an opening between the first side wall and the bottom wall, the first and second bases being unitarily joined by a coupling projecting into the opening between the first side wall and the bottom wall.

8. The terminal fitting of claim 6, wherein the first and second bases are joined unitarily by a fold line aligned substantially orthogonal to a fold line between the first base and the pressing portion.

9. The terminal fitting of claim 8, wherein the first base is joined unitarily to the second side wall by a fold line aligned parallel to the fold line between the first and second bases.

10. The terminal fitting of claim 6, wherein the first and second contacts are of different respective lengths.

* * * * *